US006334414B1

(12) United States Patent
Okada et al.

(10) Patent No.: US 6,334,414 B1
(45) Date of Patent: Jan. 1, 2002

(54) VALVE TIMING ADJUSTING APPARATUS

(75) Inventors: Motohiro Okada, Obu; Osamu Sato, Takahama; Masayasu Ushida, Okazaki, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/631,944

(22) Filed: Aug. 3, 2000

(30) Foreign Application Priority Data

Aug. 6, 1999 (JP) ..... 11-223974
Aug. 6, 1999 (JP) ..... 11-223987

(51) Int. Cl.[7] ..... F01L 1/34

(52) U.S. Cl. ..... 123/90.15; 123/90.12; 123/90.17; 123/90.31; 74/568 R

(58) Field of Search ..... 123/90.12, 90.15, 123/90.17, 90.31; 74/568 R; 464/1, 2, 160

(56) References Cited

U.S. PATENT DOCUMENTS 5,797,361 A * 8/1998 Mikame ..... 123/90.17
5,960,757 A 10/1999 Ushida
6,014,952 A * 1/2000 Sato ..... 123/90.17

* cited by examiner

*Primary Examiner*—Thomas Denion
*Assistant Examiner*—Jaime Corrigan
(74) *Attorney, Agent, or Firm*—Nixon & Vanderhye P.C.

(57) ABSTRACT

A valve timing adjusting apparatus is designed for quickly starting an engine at the intermediate position between the most retarded angle and the most advanced angle and for preventing hammering sound. A top end surface of a stopper piston receives a retard hydraulic pressure, and an annular surface of a large diameter sliding portion receives the retard hydraulic pressure from a hydraulic chamber. The retard hydraulic pressure applied to the top end surface and the annular surface acts in the direction to pull out the stopper piston from a fitting bore. An annular surface of the large diameter sliding portion receives an advance hydraulic pressure when an advance hydraulic chamber is communicated to a hydraulic chamber. The hydraulic pressure of the hydraulic chamber acts as a force for pushing the stopper piston in a fitting member. When the through hole is closed by the large diameter sliding portion, the hydraulic chamber acts as a damper chamber.

34 Claims, 10 Drawing Sheets

VALVE TIMING ADJUSTING APPARATUS

CROSS REFERENCE TO RELATED APPLICATION

This application relates to and incorporates herein by reference Japanese Patent Applications No. 11-223974 and No. 11-223987, both being filed on Aug. 6, 1999.

BACKGROUND OF THE INVENTION

1. Field of the Invention

The present invention relates to a valve timing adjusting apparatus for changing the operation timing (valve timing) of a suction valve and/or an exhaust valve of an internal combustion engine.

2. Related Art

In a vane type valve timing adjusting apparatus, a camshaft is driven by means of a timing pulley, a chain sprocket, or the like that is rotated synchronously with a crankshaft of an engine. Thus, the valve timing of a suction valve and/or an exhaust valve is hydraulically controlled based on the phase difference of relative rotation between the timing pulley or chain sprocket and a camshaft.

In the case of such a vane type valve timing apparatus that uses working fluid, a load torque that fluctuates between positive side and negative side that is caused by driving the suction valve and/or the exhaust valve is exerted on the camshaft. For example, in the state that the working fluid is not supplied sufficiently as in the engine cranking at the starting of an engine, a vane member swings toward a housing member that accommodates the vane member, and generates hammering sound due to collision between the housing member and the vane member.

It is therefore proposed that a stopper piston fits a housing member when a camshaft is positioned intermediate between the most retarded angle and the most advanced angle with respect to the crankshaft to control the relative rotation of the camshaft with respect to the crankshaft. The engine is started with the camshaft being at the intermediate position between the most retarded angle and the most advanced angle. That is, the engine is thereby started in the state that the camshaft is located at the preferable position with respect to the crankshaft.

However, a force exerted on the stopper piston to be fitted with an fitting bore is only the urging force of a spring, it is difficult to fit the stopper piston in the fitting bore within a short time. Furthermore, in the case that a hydraulic pressure for maintaining the unrestricted state in which a contact portion is disengaged from the fitting bore is low, the stopper piston jumps out to the fitting bore side due to the urging force of the spring during the phase control for rotating the vane member relatively to the housing member. As a result the stopper piston can be caught in the fitting bore.

SUMMARY OF THE INVENTION

It is an object of the present invention to provide a valve timing adjusting apparatus for enabling an engine starting promptly while minimizing hammering sound.

It is another object of the present invention to provide a valve timing adjusting apparatus for preventing a constraint member from being constrained during a phase control.

According to a valve timing adjusting apparatus of the present invention, a constraint member is provided for constraining the relative rotation of a driven side rotor with respect to a driving side rotor when the driven side rotor is positioned at the intermediate position between the most retarded angle and the most advanced angle with respect to the driving side rotor is provided. By constraining the relative rotation of the driven side rotor with respect to the driving side rotor at the intermediate position, failure in starting an engine is reduced thus minimizing noxious exhaust gas.

In addition to release of constraint state associated with a contact portion and a contact receiving portion by means of the first working fluid pressure, the contact portion is displaced in the direction to be brought into contact with the contact receiving portion by means of the second working fluid pressure. For example, the first working fluid pressure that acts on the contact portion is reduced and the second working fluid pressure is increased when the engine is to be stopped. As a result, the contact portion is surely brought into contact with the contact receiving portion at the intermediate position. Thereby, the engine is surely started in a short time.

Furthermore, by reducing the first working fluid pressure that acts on the contact portion and by increasing the second working fluid pressure when the engine is to be started, the contact portion is held in contact with the contacted portion at the intermediate position. Because the intermediate phase can be held during cranking when the engine is to be started, the engine can be started surely in a short time.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
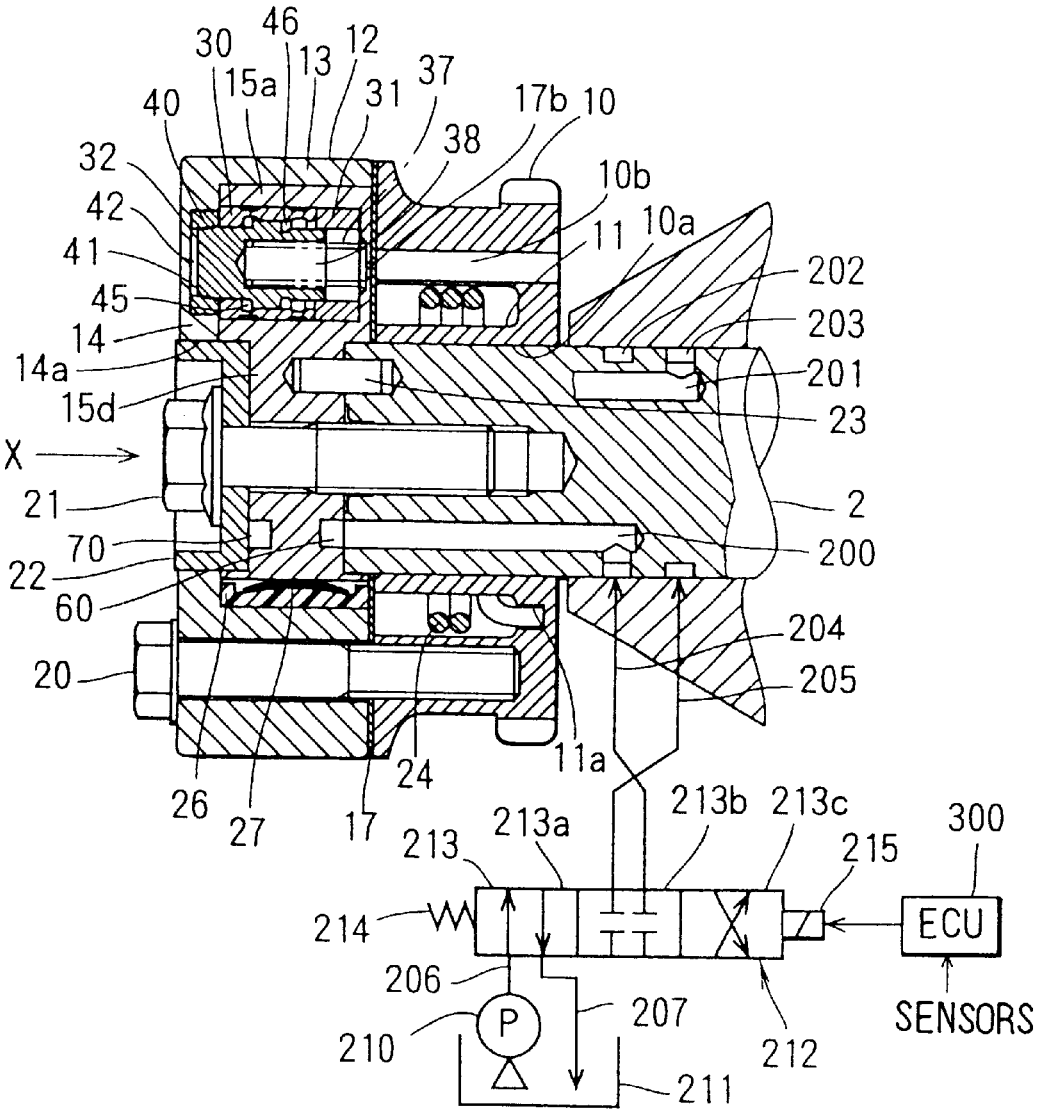
FIG. 1 is a cross sectional view showing an entirety of a valve timing adjusting apparatus according to a first embodiment of the present invention.

The present invention will be described in detail with reference to various embodiments, in which the same or like parts are designated with the same or like reference numerals.

(First Embodiment)

Referring first to FIG. 1, a valve timing adjusting apparatus 1 is of a hydraulic pressure control type for controlling the valve timing of a suction valve of an internal combustion engine (not shown).

A chain sprocket 10 that serves as one side wall of a driven side rotor is coupled with a crankshaft (not shown) that serves as a driving shaft of the engine by means of a chain (not shown) to transmit driving force from the crankshaft. It rotates synchronously with the crankshaft. A camshaft 2 that serves as a driven shaft receives a driving force from the chain sprocket 10 to operate a suction valve (not shown). The camshaft 2 is capable of rotating with a predetermined phase difference with respect to the chain sprocket 10, that is, crankshaft. The chain sprocket 10 and the camshaft 2 rotate clockwise when viewed in the direction of arrow X in FIG. 1. This rotation direction is referred to as the advance direction.

A thin plate-like intermediate plate 17 is disposed between the chain sprocket 10 and a shoe housing 12. The intermediate plate 17 prevents working fluid from leaking between the chain sprocket 10 and the shoe housing 12. The chain sprocket 10, the shoe housing 12, and the intermediate plate 17 provide a housing member that serves as a driving side rotor, and are fixed one another with bolts 20 coaxially. The shoe housing 12 comprises a cylindrical peripheral wall 13 and a front plate 14 that serves as the other side wall of the housing member and formed into a single piece.

Figure 2:
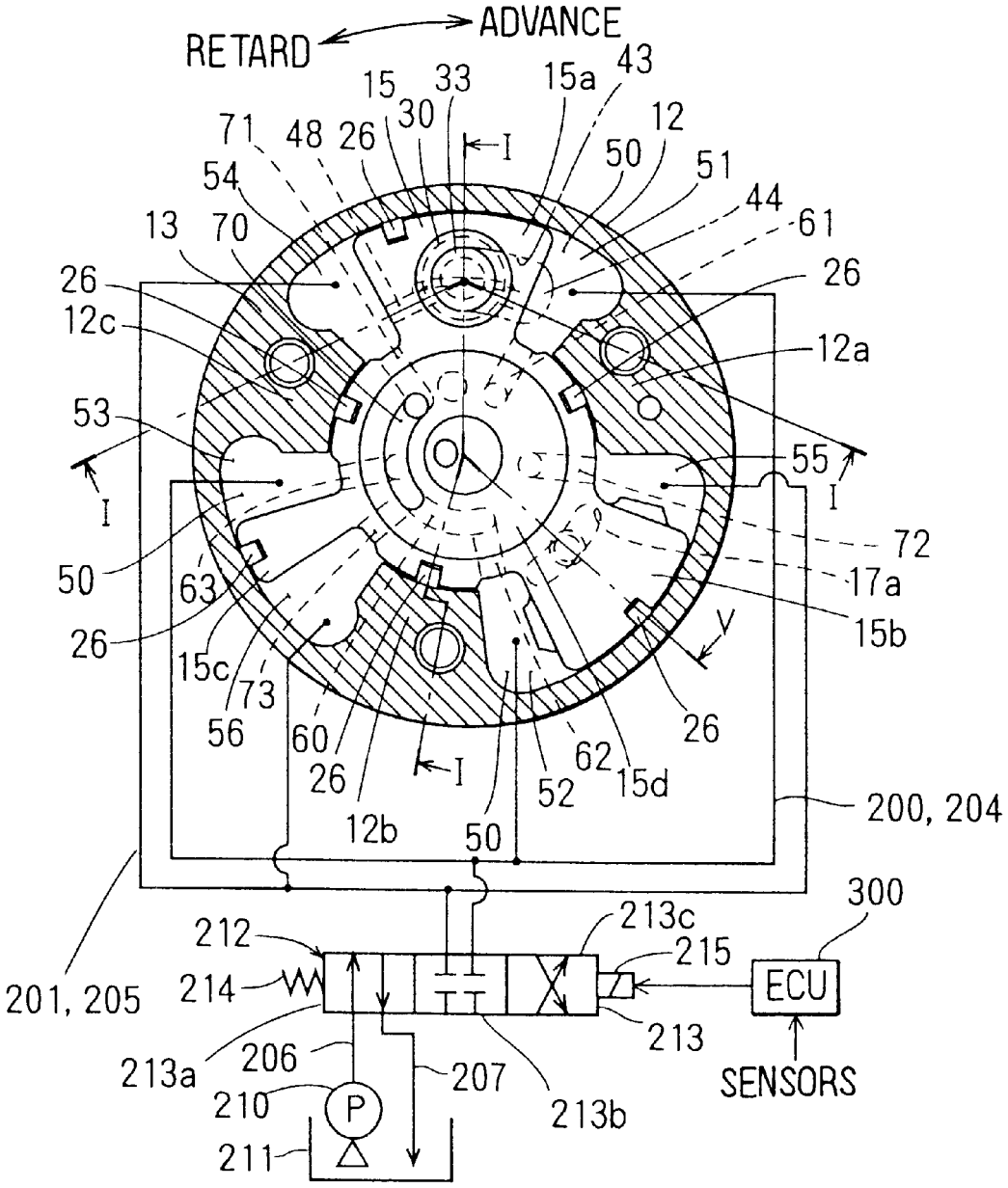
FIG. 2 is another cross sectional view showing the entirety of the valve timing adjusting apparatus according to the first embodiment.

As shown in FIG. 2, the shoe housing 12 has a plurality of shoes 12*a*, 12*b* and 12*c* that are formed in the shape of trapezoid with approximately the same angular interval in the circumferential direction. Three fan-shaped accommodation chambers 50 are provided for accommodating vanes 15*a*, 15*b* and 15*c* that serve as vane members respectively among the shoes 12*a*, 12*b* and 12*c* in the peripheral direction. The cross section of the inner peripheral surface of the shoes 12*a*, 12*b* and 12*c* is formed in the shape of arc.

The vane rotor 15 that serves as a driven side rotor has three vanes 15*a*, 15*b* and 15*c* with approximately the same angular interval in the circumferential direction. The vanes 15*a*, 15*b* and 15*c* are accommodated to be capable of rotating in respective accommodation chambers 50. Each vane divides each accommodation chamber 50 into a retard hydraulic chamber 54, 55, 56, and an advance hydraulic chamber 51, 52, 53. The arrow for indicating the retard direction and advance direction in FIG. 2 represents the retard direction and advance direction of the vane rotor 15 with respect to the shoe housing 12.

As shown in FIG. 1, the vane rotor 15 and a bushing 22 are fixed to the camshaft 2 with a bolt 21 into a single piece and provide a driven side rotor. A pin 23 is provided for positioning the vane rotor 15 with respect to the camshaft 2 in the rotation direction.

The camshaft 2 and bushing 22 are fitted in the inner peripheral wall 10*a* of the chain sprocket 10 and the inner peripheral wall 14*a* of the front plate 14 relatively capable of rotating. Therefore, the camshaft 2 and vane rotor 15 are relatively capable of rotating coaxially with respect to the chain sprocket 10 and the shoe housing 12. The inner peripheral wall 10*a* of the chain sprocket 10 and the inner peripheral wall 14*a* of the front plate 14 provide a bearing member of the driven side rotor.

A spring 24 that serves as advance urging means is accommodated in a cylindrical recess 11 formed on the chain sprocket 10. The one end of the spring 24 is engaged with a fitting bore 11*a* of the recess 11, and the other end is engaged with the vane rotor 15 through a slotted hole 17*a* formed on the intermediate plate 17.

The load that occurs when the camshaft 2 drives the suction valve fluctuates between positive side and negative side. Herein the positive direction of the load torque represents the retard direction of the vane rotor 15 with respect to the shoe housing 12, and the negative direction of the load torque represents the advance direction of the vane rotor 15 with respect to the shoe housing 12. The load torque is exerted in the positive direction, that is, retard direction in average. The urging force of the spring 24 is exerted as a torque so that the vane rotor 15 is rotated in the advance side with respect to the shoe housing 12. The magnitude of the torque in the advance direction exerted on the vane rotor 15 by the spring is approximately the same as the average load torque applied to the camshaft 2.

Sealing members 26 are fitted on the outer peripheral wall of the vane rotor 15 as shown in FIG. 2. A small clearance is formed between the outer peripheral wall of the vane rotor 15 and the inner peripheral wall of the peripheral wall 13. Each sealing member 26 prevents leakage of working fluid between the hydraulic chambers 50 through the clearance. The sealing member 26 is pressed against the peripheral wall 13 by means of the urging force of a plate spring 27 shown in FIG. 1.

Guide rings 30 and 31 are press-fitted and held in the inner wall of the vane 15*a* that forms an accommodation hole 38, and a cylindrical stopper piston 32 that serves as a contact member is accommodated in the guide rings 30 and 31 capable of sliding in the rotation axis direction of the camshaft 2. A fitting member 40 that serves as a contacted member shown in FIG. 1 having a circular cross section is press-fitted and held in a recess 14*b* formed on the front plate 14. On the fitting member 40, a fitting bore 41 with which the stopper piston 32 is in contact and capable of fitting is formed, and an enlarged bore 43 is formed. The enlarged bore 43 has the retard side end surface on the same plane as that of the retard side end surface of the fitting bore 41. The bore 43 is shallower than the fitting bore 41 and extends to the advance side.

Figure 3A:
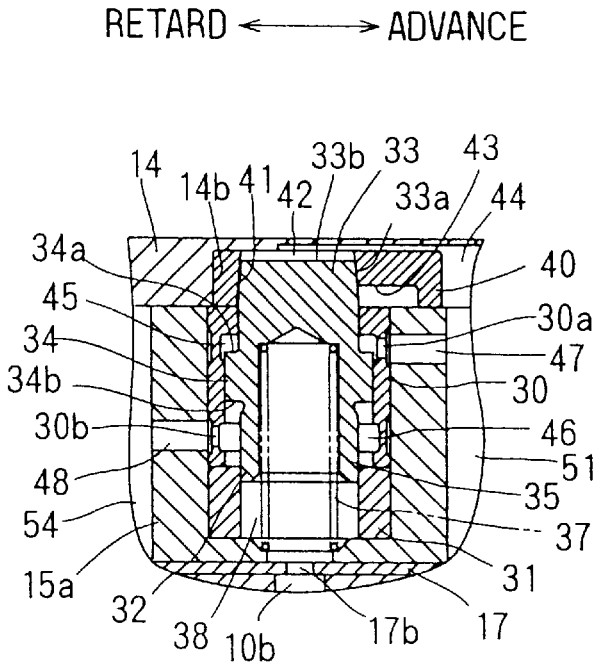
FIGS. 3A to 3C are partial cross sectional views taken along the line III—III of FIG. 2 and showing the position of a stopper piston in the first embodiment.
Figure 3B:
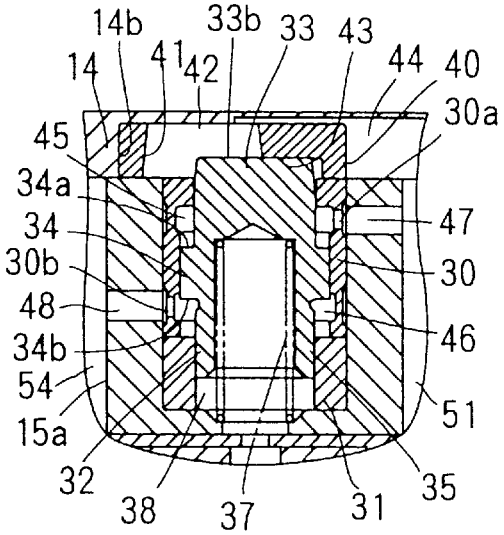
Figure 3C:
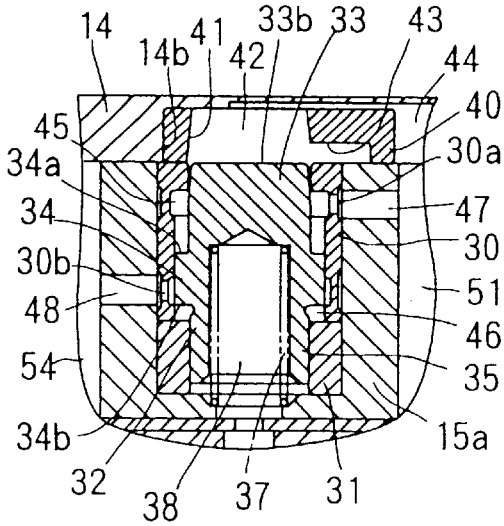

As shown in FIGS. 3A to 3C, a tapered top end 33 of stopper piston 32 has the diameter that decreases toward the fitting direction, and the fitting bore 41 is also tapered at approximately the same angle as that of the inclination of the top end 33. Therefore, the stopper piston 32 is fitted in the fitting bore 41 smoothly. Furthermore, because the fitting bore 41 is fitted with the stopper piston 32 without excessive play, generation of hammering sound due to fluctuation of the load torque is minimized. Furthermore, because the contact area of the top end 33 that is in contact with the fitting bore 41 is large, the stress applied to the top end 33 is reduced, and the life of the stopper piston 32 is extended.

A spring 37 that serves as contact urging means urges the stopper piston 32 against the fitting member 40. The stopper piston 32, the fitting member 40 and the spring 37 provide constraint means. Furthermore, the stopper piston 32 and the fitting member 40 provide regulation means.

The stopper piston 32 that is cylindrical having a bottom comprises the top end 33, a large diameter sliding portion 34 and a small diameter sliding portion 35 located in the order from the front plate 14 side. A ring taper surface 33*a* is formed on the outer periphery of the top end 33. The angle of the taper surface 33*a* is approximately the same as the taper angle of the fitting bore 41.

The retard hydraulic pressure that acts as the first working fluid pressure is applied to the top end surface 33*b* that serves as the first pressure receiving portion formed on the top end 33 from a hydraulic chamber 42, and the retard hydraulic pressure is also applied to the annular surface 34*a* that serves as the third pressure receiving portion formed on the fitting bore side of the larger diameter sliding portion 34 from a hydraulic chamber 45. The retard hydraulic pressure that is applied to the top end surface 33*b* and the annular surface 34*a* acts in the direction to push out the stopper piston 32 from the fitting bore 41.

The annular surface 34*b* formed on the side opposite to the fitting bore side of the large diameter sliding portion 34 as the second pressure receiving portion receives the advance hydraulic pressure as the second working fluid pressure from a hydraulic chamber 46 that communicates to an advance hydraulic chamber 54 through a fluid passage 48 and a through hole 30*b* in the state that the stopper piston 32 is fitted in the fitting bore 41 or the enlarged bore 43, that is, in the constraint state as shown in FIG. 3A and FIG. 3B.

In FIG. 3A and FIG. 3B, the hydraulic pressure of the hydraulic chamber 46 acts in the direction to fit the stopper piston 32 in the fitting bore 41. As shown in FIG. 3C, when the stopper piston 32 is pushed out from the enlarged bore 43, that is, at the boundary position between unconstraint state and constraint state associated with the stopper piston 32 and the fitting member 40, the through hole 30*b* that serves as the second working fluid passage is closed by the large diameter sliding portion 34. Thus, the communication between the hydraulic chamber 46 and the advance hydraulic chamber 54 is shut down. At this time, the hydraulic pressure of the hydraulic chamber 46 is equalized to the atmospheric pressure, and does not act to push the stopper piston 32 toward the fitting member 40.

Figure 4:
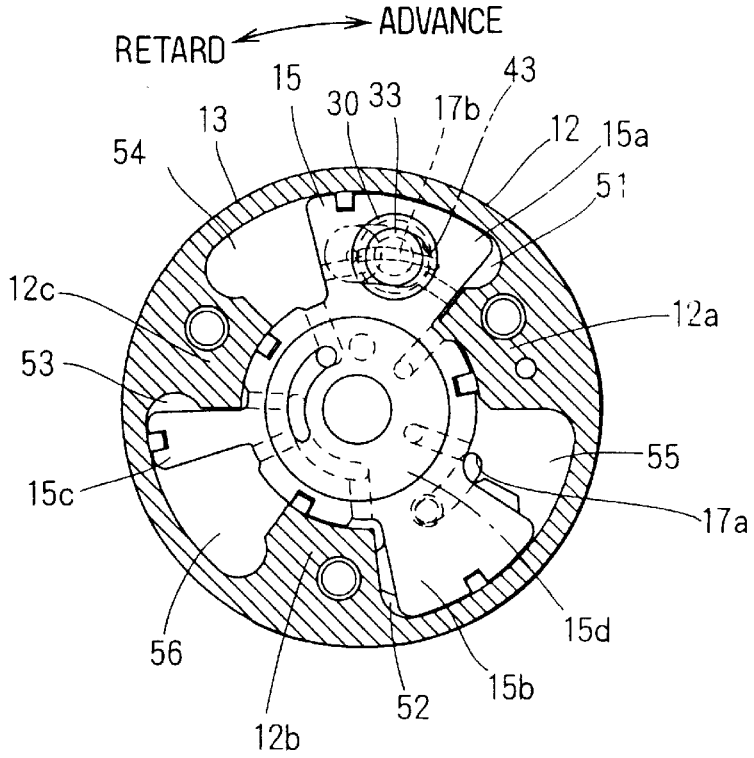
FIG. 4 is a cross sectional view showing the position of a vane rotor located at the most advanced position in the first embodiment.
Figure 5:
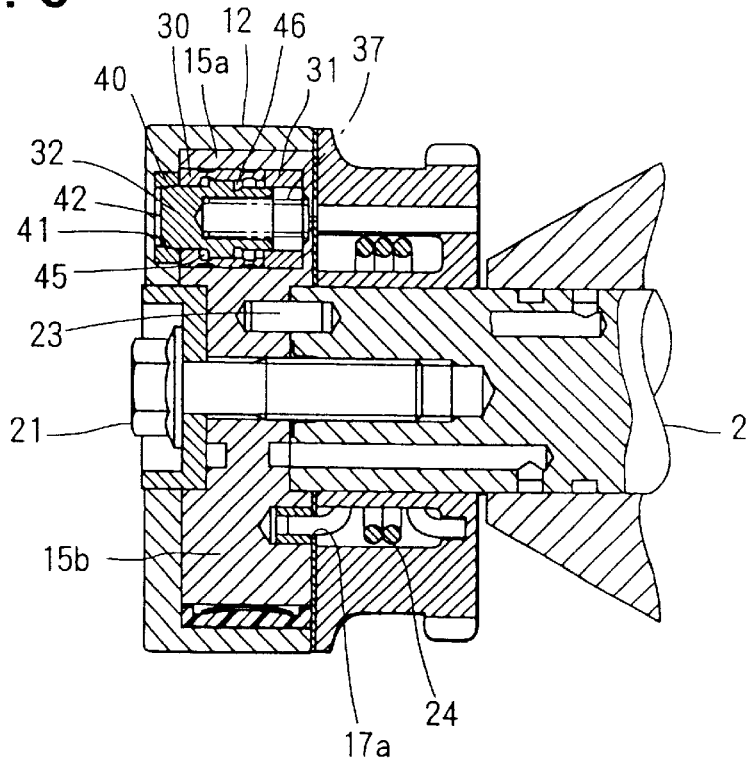
FIG. 5 is a cross sectional view taken along the line I-O-V of FIG. 2.

The accommodation hole 38 of the side opposite to the fitting member side of the stopper piston 32 is open to the atmosphere through the slotted hole 17*a* formed on the intermediate plate 17 and a fluid passage 10*b* formed on the chain sprocket 10 not only when the vane rotor 15 is located within the relative rotation angle range, that is, at the most advanced position with respect to the shoe housing 12 as shown in FIG. 4 but also when the vane rotor is located at the most retarded position. Therefore, the hydraulic pressure of the working fluid that leaked from the sliding clearance between the small diameter sliding portion 35 and the guide ring 31 to the accommodation hole 38 of the side opposite to the fitting member side of the stopper piston 32 is approximately equal to the atmospheric pressure. Therefore, the working fluid that leaked to the accommodation hole 38 of the side opposite to the fitting member side of the stopper piston 32 does not act as the force to push the stopper piston 32 toward the fitting member 32.

Sliding portions of the stopper piston 32 slide on the inner peripheral wall of the guide ring 30 or guide ring 31. The top end 33 of the stopper piston 32 can be fitted in the fitting bore 41 when the vane rotor 15 is positioned at the intermediate position between the most retarded position and the most advanced position with respect to the shoe housing 12 as shown in FIG. 2.

In the state that the stopper piston 32 is fitted in the fitting bore 41, the relative rotation of the vane rotor 15 with respect to the shoe housing 12 is constrained. As shown in FIG. 3A, when the stopper piston 32 is fitted in the fitting bore 41, the intermediate position where the relative rotation between the shoe housing 12 and the vane rotor 15 is the position that sets the optimal phase difference between the crankshaft and the camshaft 2, that is, the optimal valve timing of the suction valve that enables the starting of the engine surely.

When the vane rotor 15 is rotated to the retard side with respect to the shoe housing 12 from the state shown in FIG. 3C, the circumferential position of the stopper piston 32 deviates from that of the fitting bore 41. It becomes impossible that the stopper piston 32 is fitted in the fitting bore 41. When the vane rotor 15 is rotated up to the most advanced angle from the intermediate position with respect to the shoe housing 12, the stopper piston 32 locates on the enlarged bore 43 as shown in FIG. 3B.

A fluid passage 44 formed on the front plate 14 communicates between a retard hydraulic chamber 51 and the hydraulic chamber 42. A through hole 30*a* that passes through the guide ring 30 is formed on the guide ring 30. A fluid passage 47 and the through hole 30*a* communicate between the retard hydraulic chamber 51 and the hydraulic chamber 45. The through hole 30*b* formed on the guide ring 30 can communicate between the hydraulic chamber 46 and the fluid passage 48.

As shown in FIG. 2, the retard hydraulic chamber 51 is formed between the shoe 12*a* and the vane 15*a*. The retard hydraulic chamber 52 is formed between the shoe 12*b* and the vane 15*b*. The retard hydraulic chamber 53 is formed between the shoe 12*c* and the vane 15*c*. Furthermore, the advance hydraulic chamber 54 is formed between the shoe 12*c* and the vane 15*a*. The advance hydraulic chamber 55 is formed between the shoe 12*a* and the vane 15*b*. The advance hydraulic chamber 56 is formed between the shoe 12*b* and the vane 15*c*.

The retard hydraulic chamber 51 communicates to a fluid passage 61. The retard hydraulic chambers 52 and 53 communicate to a fluid passage 60 formed in C-shape on the camshaft side end surface of the boss portion 15*d* shown in FIG. 2 through oil passages 62 and 63. Furthermore, the retard hydraulic chambers 51, 52 and 53 communicate to a fluid passage 200 formed on the camshaft 2 shown in FIG. 1 through the fluid passages 60 and 61.

As shown in FIG. 2, the advance hydraulic chamber 55 communicates to a fluid passage 72. The advance hydraulic chambers 54 and 56 communicate to a fluid passage 70 formed in C-shape on the bushing side end surface of the boss 15*d* through oil passages 71 and 73. Furthermore, the advance hydraulic chambers 54, 55 and 56 communicate to a fluid passage 201 formed on the camshaft shown in FIG. 1 through a fluid passage (not shown) formed in the axial direction of the boss portion 15*d* from the fluid passages 70 and 72.

The fluid passage 200 communicates to a groove passage 202 formed on the outer peripheral wall of the camshaft 2. The fluid passage 201 communicates to a groove passage 203 formed on the outer peripheral wall of the camshaft 2. The groove passage 202 is connected to a switching valve 212 through a fluid passage 204. The groove passage 203 is connected to the switching valve 212 through a fluid passage 205. An oil supply passage 206 that serves as a working fluid supply passage is connected to a fluid pump 210. An oil drain passage 207 that serves as a working fluid discharging passage is open to a drain 211. The oil pump 210 pumps up working fluid from the drain and supplies it to hydraulic chambers through the switching valve 212. The switching valve 212 is a well known 4-port guide valve.

A valve member 213 of the switching valve 212 is urged in one direction by a spring 214, and reciprocated by controlling a current supplied to a solenoid 215. The current supplied to the solenoid 215 is controlled by an engine control unit (ECU) 300. The ECU 300 receives the detection signals from various sensors and transmits the signal to components of the engine. By reciprocating the valve member 213, the combination of communication and shutdown between the fluid passages 204 and 205, the oil supply passage 206 and the oil drain passage 207 is switched. The above oil passage structure allows working fluid to be supplied from the oil pump 210 to the retard hydraulic chambers 51, 52 and 53, or the advance hydraulic chambers 54, 55 and 56, and the hydraulic chambers 42, 45 and 46. It also allows the working fluid to be drained from oil pressure chambers to the drain 211.

In operation, when an ignition is turned off to stop the engine, a valve position 213*a* is selected because the ECU 300 turns off a current supplied to the solenoid 215. Then, working fluid is supplied to the advance hydraulic chambers, and the retard hydraulic chambers. The hydraulic chambers 42 and 45 are opened to the drain. Thereby, the vane rotor 15 is rotated to the advance side with respect to the shoe housing 12.

At this time, when the stopper piston 32 is separated from the fitting member 40 far from the position as shown in FIG. 3C, that is, when the stopper piston 32 is in unconstraint from the fitting bore 41 and the enlarged bore 43, the communication between the hydraulic chamber 46 and the advance hydraulic chamber 54 is shut down by the large diameter sliding portion 34. Therefore, the hydraulic pressure of the hydraulic chamber 46 does not act to push the stopper piston 32 toward the fitting member 40. However, because the hydraulic pressure in the hydraulic chambers 42 and 45 decrease, the urging force of the spring 37 pushes the stopper piston 32 to move toward the fitting member 40.

When an engine stop is indicated in the state that the vane rotor 15 is positioned with deviation to the retard side with respect to the shoe housing 12 from the intermediate position (constraint position) where the stopper piston 32 is fitted in the fitting bore 41, the working fluid is supplied to the advance hydraulic chambers to thereby rotate the vane rotor 15 to the advance side. The stopper piston 32 is moved toward the fitting member 40 by means of the urging force of the spring 37, and the unconstraint state changes to the constraint state. At this time, the large diameter sliding portion 34 releases the closed through hole 30*b*, and the through hole 30*b* begins to open.

Then, the hydraulic chamber 46 becomes communicative to the advance hydraulic chamber 54 through the through hole 30*b*, and the working fluid is supplied from the advance hydraulic chamber 54 to the hydraulic chamber 46. Therefore, the hydraulic pressure of the hydraulic chamber 46 acts as a pushing force that pushes the stopper piston 32 toward the fitting member 40.

When the vane rotor 15 reaches the intermediate position (constraint position) shown in FIG. 3A with respect to the shoe housing 12, the stopper piston 32 is fitted in the fitting bore 41 by means of the urging force of the spring 37 and a force supplied from the hydraulic chamber 46. If the stopper piston 32 cannot be fitted in the fitting bore 41, the vane rotor 15 is rotated toward the advance side beyond the intermediate position and fitted with the enlarged bore 43.

When an engine stop is instructed in the state that the vane rotor 15 is positioned at the advance side with respect to the shoe housing 12 with deviation from the intermediate position where the stopper piston 32 is to be fitted in the fitting bore 41, the vane rotor 15 is rotated to the advance side and the stopper piston 32 is resultantly fitted in the enlarged bore 43.

When the stopper piston 32 is fitted in the fitting bore 41 before starting of the engine, the phase difference of the vane rotor 15 with respect to the shoe housing 12, that is, the phase difference of the camshaft 2 with respect to the crankshaft is maintained at the most preferable position for starting the engine. Thus, the engine can be started surely within a short time.

It is assumed here that the engine is started in the state that the stopper piston 32 is not fitted in the fitting bore 41 before the engine is started and the camshaft 2 is positioned at the advance side from the intermediate position with respect to the crankshaft. In this instance, the stopper piston 32 is fitted in the enlarged bore 43. Because the advance torque applied to the vane rotor 15 and the camshaft 2 by the spring 24 is approximately equal to the averaged load torque, the maximum value of the load torque exerted in the retard direction of the positive side is larger than the urging force of the spring 24. The vane rotor 15 swings to the retard side with respect to the shoe housing 12 against the urging force of the spring 24 that is exerted in the advance direction with changing of the load torque.

The vane rotor 15 is stopped on the retard side surface of the enlarged bore 43 at the intermediate position. The working fluid is not introduced into the hydraulic chambers 42 and 45 during cranking when the engine is to be started. When the stopper piston 32 reaches the intermediate position, the stopper piston 32 is fitted in the fitting bore 41 by means of the urging force of the spring 37 and the force received from the hydraulic chamber 46.

The stopper piston 32 is fitted in the enlarged bore 43 even when the stopper piston 32 is not fitted in the fitting bore 41 before the engine is started. When the engine is started, the stopper piston 32 is fitted in the fitting bore 41 quickly, and the camshaft 2 is held at the intermediate position with respect to the crankshaft. As a result, the engine is started surely in a short time.

Because the valve position 213*a* of the switching valve 212 is selected during cranking when the engine is to be started, the working fluid is supplied to the advance hydraulic chambers and the hydraulic chamber 46, and the retard hydraulic chambers and the hydraulic chamber 42 are opened to the drain. Therefore, the stopper piston 32 will not be pulled out from the fitting bore 41 or the enlarged bore 43.

After the engine is started, the working fluid is charged to the retard hydraulic chambers and the hydraulic pressure of the hydraulic chambers 42 and 45 increases up to a predetermined pressure. Then, the stopper piston 32 is pulled out from the fitting bore 41. The relative rotation of the vane rotor 15 with respect to the shoe housing 12, that is, the phase control becomes possible. When the stopper piston 32 moves from the fitting bore 41 in the unconstraint direction shown in FIG. 3C, the through hole 30*b* is closed by the large diameter sliding portion 34. The communication between the hydraulic chamber 46 and the advance hydraulic chamber 54 is shut down. The hydraulic chamber 46 is almost sealed.

The hydraulic pressure of the working fluid increases to a sufficient value after the engine is started. Then, either one of the valve portions 213*a,* 213*b* and 213*c* of the valve member 213 is selected depending on the instruction given by the ECU 300. Thereby, the supply of the working fluid to the hydraulic chambers and drain of the working fluid from the hydraulic chambers are controlled. The relative rotation of the vane rotor 15 with respect to the shoe housing 12 is controlled.

While the engine is being operated normally, the stopper piston 32 is kept at the position far from the position where the stopper piston 32 is just pulled out as shown in FIG. 3C. Therefore, the hydraulic chamber 46 is almost sealed as described above. Even though the hydraulic pressure of the hydraulic chambers 42 and 45 decrease so that the stopper piston 32 is to be moved toward the fitting member 40, the hydraulic pressure 46 acts as a damper chamber and the moving speed is reduced.

Therefore, even though the stopper piston 32 is to be moved toward the fitting member 40 due to reduction of the hydraulic pressure when the stopper piston 32 passes on the fitting member 40 concomitantly with the relative rotation of the vane rotor 15 with respect to the shoe housing 12, the hydraulic chamber 46 acts as a damper chamber and the stopper piston 32 passes on the fitting member 40 without fitting with the fitting member 40, and thus the stopper piston 32 is prevented from being fitted with the fitting member 40.

The first working fluid pressure is assigned to the retard side and the second working fluid pressure is assigned to the advance side. The advance pressure is increased when the engine is to be stopped to thereby help the fitting of the stopper piston 32 for stopping.

(Second Embodiment)

Figure 6A:
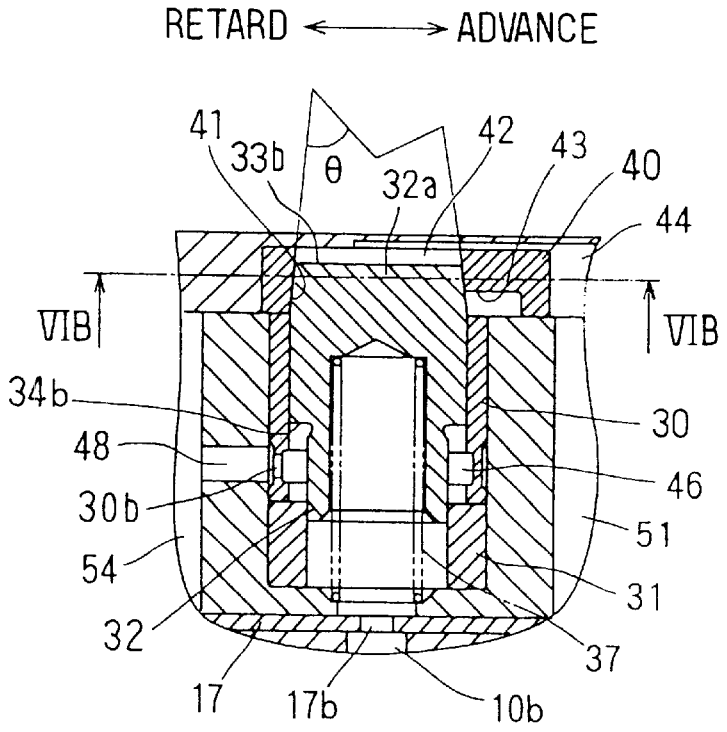
FIGS. 6A and 6B are cross sectional views showing position of a stopper piston and shape of a fitting member, respectively, in a second embodiment of the present invention.

In a second embodiment shown in FIG. 6A, the stopper piston 32 is provided with only one pressure receiving portion for receiving the retard hydraulic pressure as the first pressure receiving portion at the top end surface 32*a* of the top end. The second pressure receiving portion for receiving the advance hydraulic pressure is formed as an annular surface of the top end on the side opposite to the fitting member 40.

When the stopper piston 32 is pulled out entirely from the fitting bore 41 and the enlarged bore 43 and brought into the unconstraint state, a through hole 30*b* is closed by the top end. Thereby, the communication between the hydraulic chamber 46 and the advance hydraulic chamber 54 is shut down, and the hydraulic chamber 46 acts as a damper chamber.

The taper angle θ of the top end is formed to be 15 degrees or less. Because the taper angle θ is sharp, a frictional force that overcomes the load torque that the camshaft 2 receives is generated in the space of the fitting bore 41 formed on the fitting member 40 by means of the force received from the spring 37 and the advance hydraulic pressure of the hydraulic chamber 46. As a result, the stopper piston 32 is kept fitted in the fitting bore 41. Furthermore, the variation of the fitting depth of the stopper piston 32 that is fitted in the fitting bore 41 is reduced.

Figure 6B:
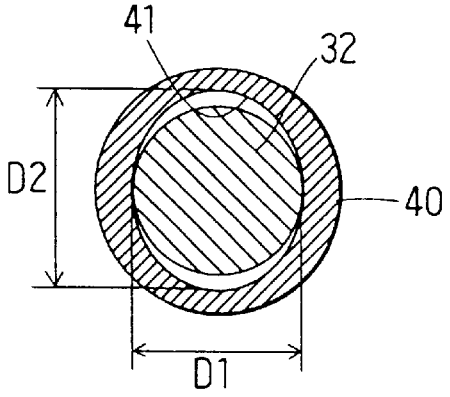

The fitting bore 41 formed on the fitting member 40 is a slotted hole that extends in the rotation direction of the stopper piston 32, that is, in the direction perpendicular to the rotation direction of the vane rotor 15 as shown in FIG. 6B. In detail, the diameter D2 of the fitting bore 41 in the direction perpendicular to the rotation direction is larger than the diameter D1 of the fitting bore 41 in the rotation direction.

Even if the fitting bore 41 or stopper piston 32 has some manufacturing allowance in the direction perpendicular to the rotation direction, the stopper piston 32 can be fitted in the fitting bore 41. The limitation on the manufacturing allowance can be mitigated. As a result, the manufacturing becomes easy and the manufacturing cost is reduced.

In the first and second embodiments, the retard hydraulic pressure is applied to the stopper piston in the direction to pull out the stopper piston from the fitting bore and the enlarged bore, and the advance hydraulic pressure is applied to the stopper piston in the direction to push the stopper piston in the fitting member. Therefore, the retard hydraulic chamber is opened to the drain and the working fluid is supplied to the advance hydraulic chamber when an engine stop is instructed. The stopper piston can be thereby fitted surely in the fitting bore at the intermediate position. Because the engine is started in the state that the vane rotor is held at the intermediate position with respect to the shoe housing, the engine can be started surely in a short time.

In addition to the constraint means for constraining the vane rotor at the intermediate position with respect to the shoe housing by fitting the stopper piston in the fitting bore, the enlarged bore serving as regulation means for preventing the vane rotor from rotating from the intermediate position toward the retard side and for allowing the vane rotor to rotate toward the advance side is formed. Therefore, the stopper piston is fitted in the enlarged bore and stopped at the retard side of the enlarged bore, and the stopper piston is thereby fitted surely with the fitting bore. As a result, the engine is stopped in the state that the vane rotor is held at the intermediate position with respect to the shoe housing, which position is most suitable for engine starting. Therefore, the engine can be started surely in a short time.

Because the through holes 30*b* and 30*b* that communicate between the hydraulic chamber 46 and the advance hydraulic chamber 54 are closed/opened by displacing the stopper piston, the through holes 30*b* and 30*b* are surely opened/closed by displacing the stopper piston 32. Furthermore, because other opening/closing valves and switching valves are not needed for opening/closing the second working fluid passage that communicates between the hydraulic chamber 46 and the advance hydraulic chamber 54, the number of necessary parts is reduced, the assembling work becomes simple, and the manufacturing cost is reduced.

(Third Embodiment)

In a third embodiment shown in FIGS. 7A–7C to 11, the top end surface 33*b* that serves as the first pressure receiving portion formed on the top end 33 receives the retard hydraulic pressure that serves as the first working fluid pressure from the hydraulic chamber 42. The annular surface 34*a* that serves as the second pressure receiving portion formed on the fitting bore side of the large diameter sliding portion 34 receives the advance hydraulic pressure from the hydraulic chamber 45 and the retard hydraulic pressure exerted on the top end surface 33*b*. The advance hydraulic pressure exerted on the annular surface 34*a* act in the direction to pull out the stopper piston 32 from the fitting bore 41. The hydraulic chamber 42 communicates to the retard hydraulic chamber 51 through the fluid passage 44 formed on the front plate 14. The hydraulic chamber 45 communicates to the advance hydraulic chamber 54 through the fluid passage 47 formed on the vane 15*a* and the through hole 30*a* formed on the guide ring 30.

The fluid passage 47 and the through hole 30*a* provide the second pressure receiving passage. The pressure receiving area of the top end surface 33*b* is larger than the pressure receiving area of the annular surface 34*a* and the annular surface 34*b* that serves as the third pressure receiving portion that will be described hereinafter. Furthermore, the pressure receiving area of the annular surface 34*a* is larger than the pressure receiving area of the annular surface 34*b*.

The annular surface 34*b* that serves as the third pressure receiving portion formed on the side opposite to the fitting bore side of the large diameter sliding portion 34 receives the advance hydraulic pressure that serves as the second working fluid pressure from the hydraulic chamber 46. The hydraulic chamber 46 communicates to the advance hydraulic chamber 54 through the fluid passage 48 formed on the vane 15*a* and the through hole 30*b* formed on the guide ring 30. The fluid passage 48 and the through hole 30*b* provide the third pressure receiving passage.

Figure 7A:
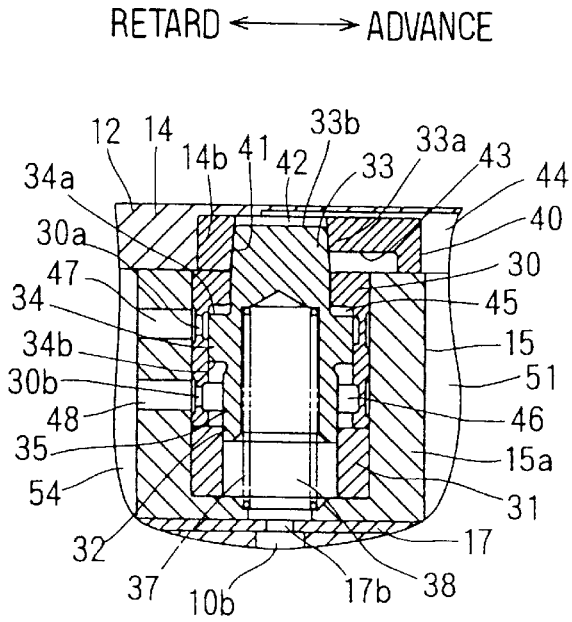
FIGS. 7A to 7C are partial cross sectional views taken along the line VII—VII of FIG. 8 and showing the position of a stopper piston in a third embodiment of the present invention.

As shown in FIG. 7A, in the state that the stopper piston 32 is fitted in the fitting bore 41, the through hole 30*a* is closed by the large diameter sliding portion 34. Then, because the working fluid in the advance hydraulic chamber 54 is not supplied to the hydraulic chamber 45, the hydraulic pressure of the hydraulic chamber 45 does not act in the direction to pull out the stopper piston 32 from the fitting bore 41.

Figure 7B:
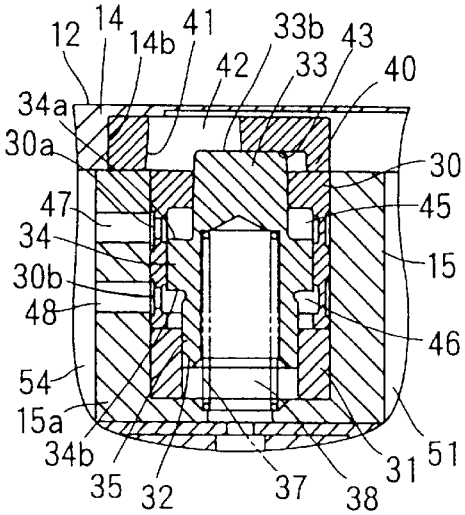
Figure 7C:
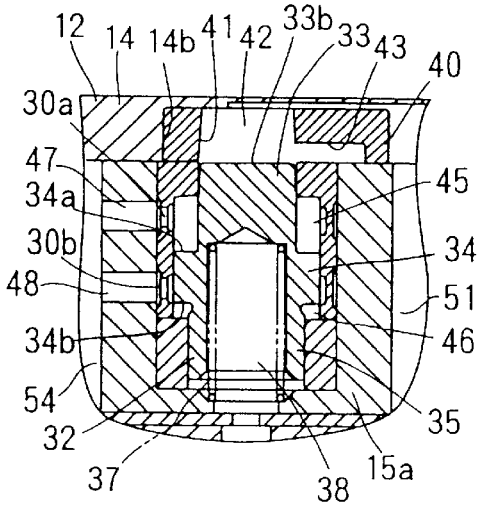
Figure 8:
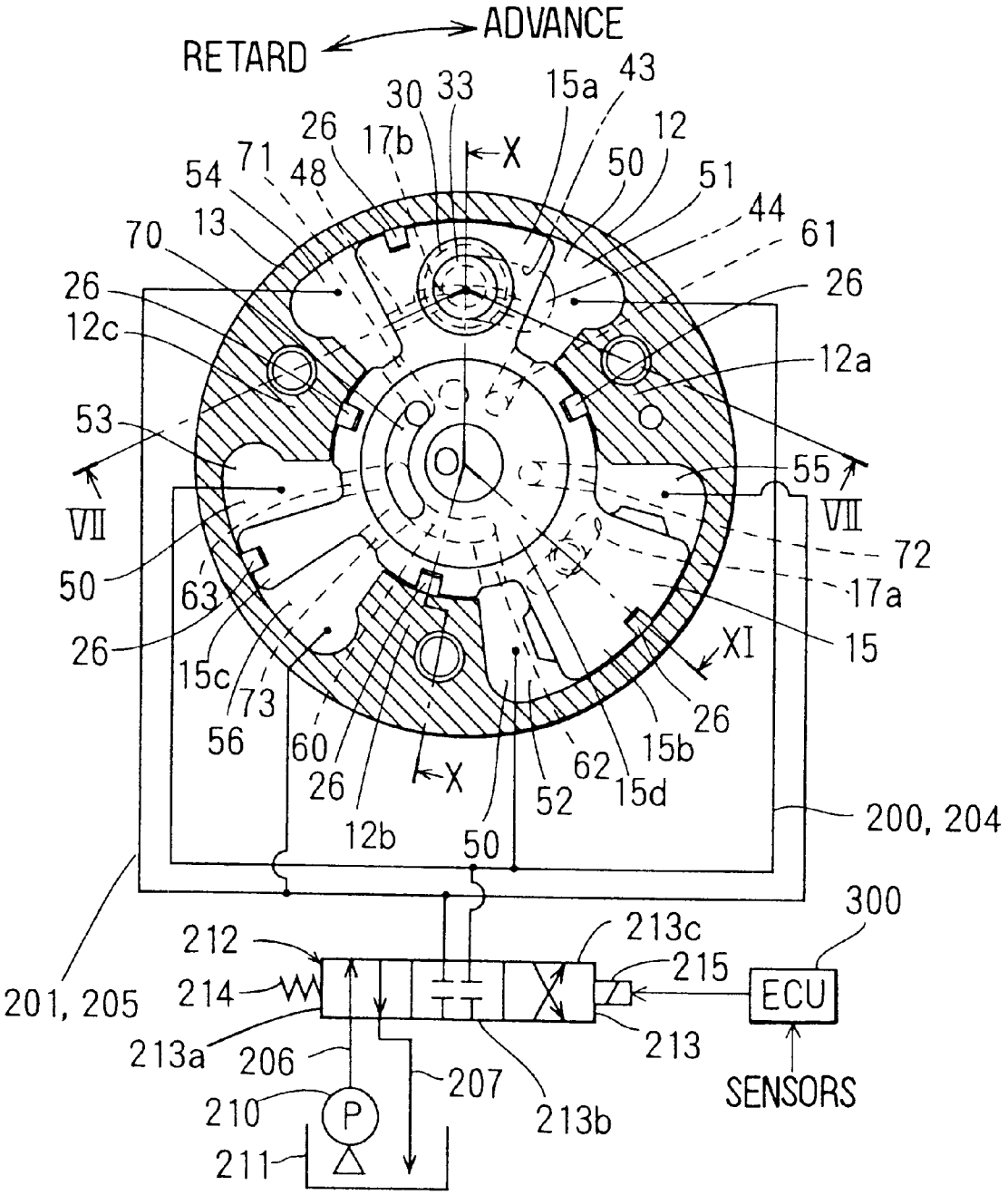
FIG. 8 is a cross sectional view showing an entirety of a valve timing adjusting apparatus according to the third embodiment.

Furthermore, as shown in FIG. 7C, when the stopper piston 32 is pulled out from the enlarged bore 43, that is, at the boundary position between the unconstraint state and the constraint state associated with the stopper piston 32 and the fitting member 40, the through hole 30*b* is closed by the large diameter sliding portion 34. The working fluid in the advance hydraulic chamber 54 is not supplied to the hydraulic chamber 46. At this time, because the hydraulic pressure of the hydraulic chamber 46 is equal to the atmospheric pressure, the hydraulic pressure does not act as the force to push the stopper piston 32 toward the fitting member 49.

As shown in FIG. 7C, when the vane rotor 15 rotates toward the retard side with respect to the shoe housing 12 in the state that the stopper piston 32 is pulled out from the fitting bore 41 and the enlarged bore 43, the circumferential position of the stopper piston 32 and that of the fitting bore 41 are deviated each other. As a result, it becomes impossible for the stopper piston 32 to be fitted in the fitting bore 41.

In operation of the third embodiment, when an ignition is turned off to stop the engine, a valve position 213*a* is selected because the ECU 300 turns off a current supplied to the solenoid 215. Then, working fluid is supplied to the advance hydraulic chambers and the hydraulic chambers 45 and 46. The retard hydraulic chambers and the hydraulic chamber 42 are opened to the drain. Thereby, the vane rotor 15 is rotated to the advance side with respect to the shoe housing 12.

At this time, when the stopper piston 32 is separated from the fitting member 40 far from the position as shown in FIG. 3C, that is, when the stopper piston 32 is in unconstraint from the fitting bore 41 and the enlarged bore 43, the communication between the hydraulic chamber 46 and the advance hydraulic chamber 54 is shut down by the large diameter sliding portion 34. Therefore, the hydraulic pressure of the hydraulic chamber 46 does not act to push the stopper piston 32 toward the fitting member 40. However, because the hydraulic pressure in the hydraulic chamber 42 decrease, the urging force of the spring 37 pushes the stopper piston 32 to move toward the fitting member 40.

When an engine stop is indicated in the state that the vane rotor 15 is positioned with deviation to the retard side with respect to the shoe housing 12 from the intermediate position (constraint position) where the stopper piston 32 is fitted in the fitting bore 41, the working fluid is supplied to the advance hydraulic chambers to thereby rotate the vane rotor 15 to the advance side. The stopper piston 32 is moved toward the fitting member 40 by means of the urging force of the spring 37, and the unconstraint state changes to the constraint state. At this time, the large diameter sliding portion 34 releases the closed through hole 30*b*, and the through hole 30*b* begins to open.

Then, the hydraulic chamber 46 becomes communicative to the advance hydraulic chamber 54 through the through hole 30*b*, and the working fluid is supplied from the advance hydraulic chamber 54 to the hydraulic chamber 46. Therefore, the hydraulic pressure of the hydraulic chamber 46 acts as a pushing force that pushes the stopper piston 32 toward the fitting member 40.

Figure 9:
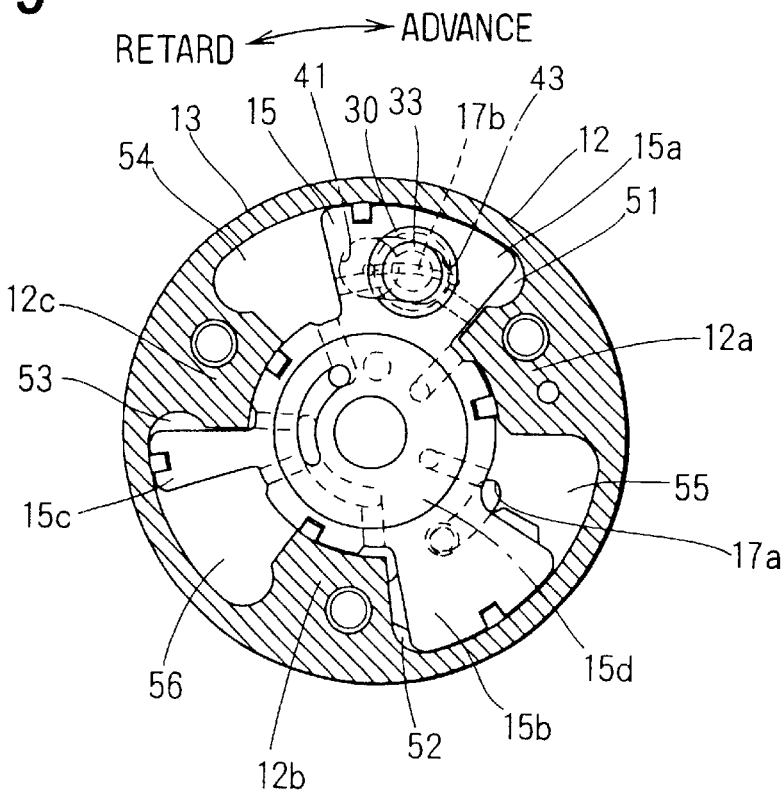
FIG. 9 is a cross sectional view showing the state that a vane rotor is positioned at the most advanced position in the third embodiment.
Figure 11:
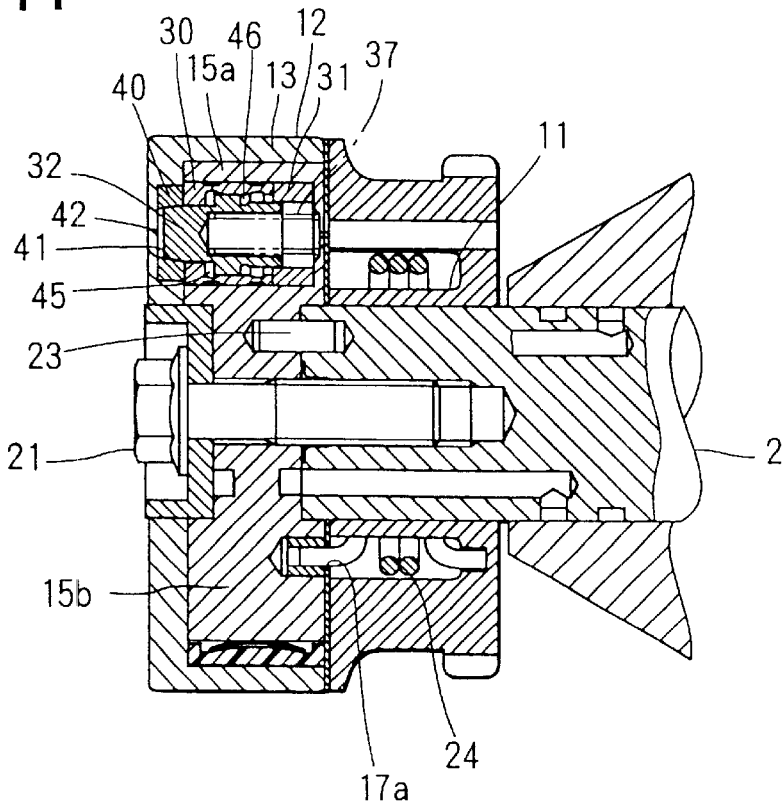
FIG. 11 is a cross sectional view taken along the line X-O-XI of FIG. 8.
Figure 10:
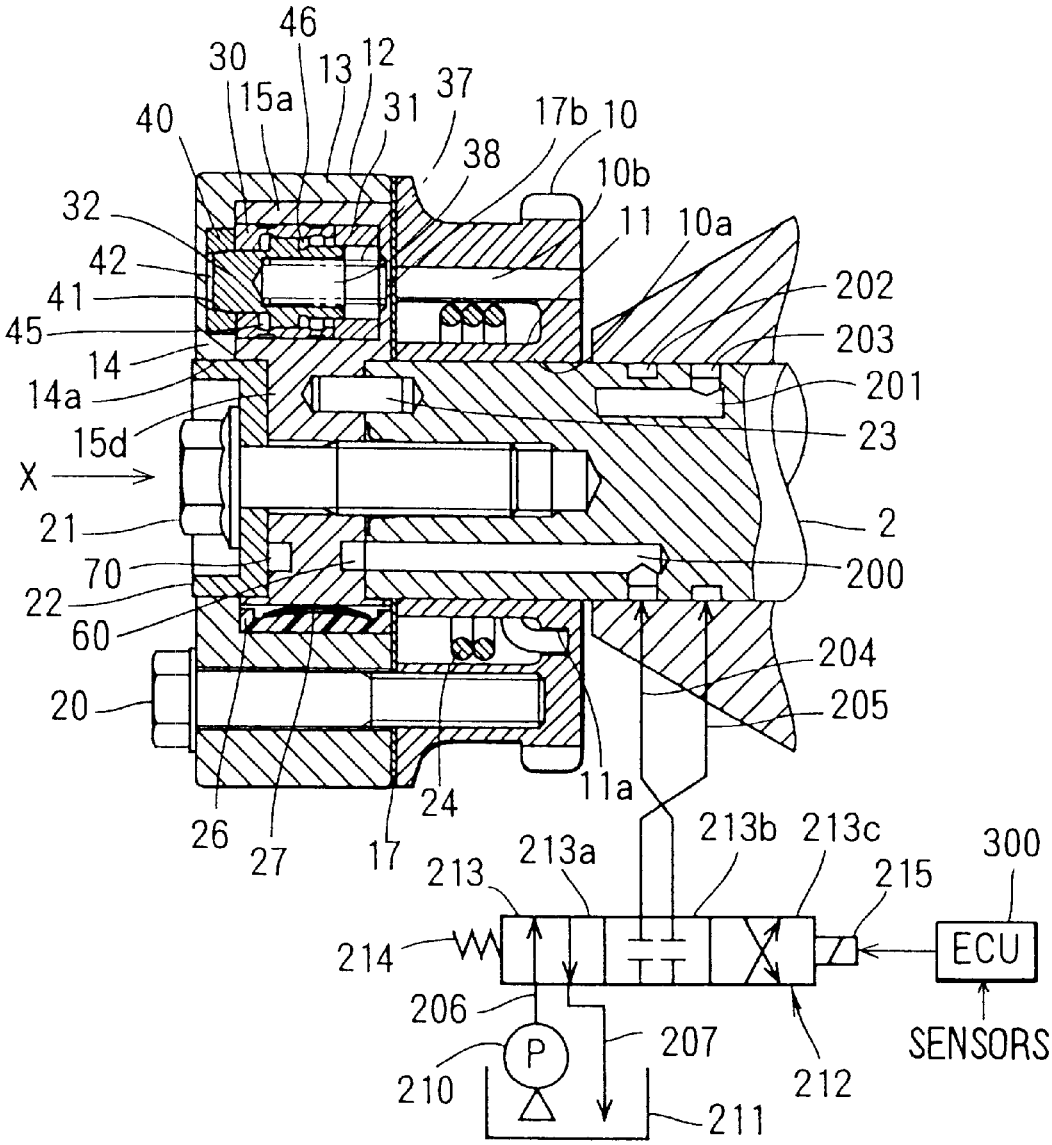
FIG. 10 is a cross sectional view taken along X-O-X of FIG. 8.

As shown in FIG. 9, when the vane 15*b* is stopped by the shoe 12*b* and the vane rotor 15 reaches the most advanced position with respect to the shoe housing 12, the stopper piston 32 is positioned in the enlarged bore 43 as shown in FIG. 7B.

When the vane rotor 15 reaches the intermediate position (constraint position) shown in FIG. 7A with respect to the shoe housing 12, the stopper piston 32 is stopped on the retard side end surface of the enlarged bore 43. The stopper piston 32 is fitted in the fitting bore 41 by the urging force of the spring 37 and the force received from the hydraulic chamber 46. When the stopper piston 32 is fitted in the fitting bore 41, the through hole 30*a* is closed by the large diameter sliding portion 34. Therefore, because the working fluid in the hydraulic chamber 45 does not act as a force to pull out the stopper piston 32 from the fitting bore 41, the constraint state shown in FIG. 7A is held. If the stopper piston 32 fails to fit in the fitting bore 41, then the vane rotor 15 rotates toward the advance side with respect to the intermediate position and fits in the enlarged bore 43.

When an engine stop is instructed in the state that the vane rotor 15 is positioned on the advance side with respect to the shoe housing 12 from the intermediate position where the stopper piston 32 is fitted in the fitting bore 41, the vane rotor 15 rotates toward the advance side. The stopper piston 32 is thereby fitted in the enlarged bore 43.

In the case that the stopper piston 32 is fitted in the fitting bore 41 before the engine is started, the phase difference of the vane rotor 15 with respect to the shoe housing 12, that is, the phase difference of the camshaft 2 with respect to the crankshaft, is held in the most preferable phase for starting the engine. As a result, the engine can be started surely in a short time.

It is assumed that the engine is started in the state that the stopper piston 32 is not fitted in the fitting bore 41 before the engine is started and the camshaft 2 is positioned on the advance side to the crankshaft with respect to the intermediate position. At this time, the stopper piston 32 is fitted in the enlarged bore 43. Because the advance torque exerted on the vane rotor 15 and the camshaft 2 by the spring 24 is approximately equal to the averaged load torque, the maximum value of the load torque exerted in the positive side retard direction is larger than the urging force of the spring 24.

Because the working fluid is not supplied to the retard hydraulic chambers and the advance hydraulic chambers during cranking when the engine is to be started, the vane rotor 15 swings toward the retard side with respect to the shoe housing 12 against the urging force of the spring 24 that is exerted in the advance direction concomitantly with the variation of the load torque. The vane rotor 15 is stopped on the surface of the retard side of the enlarged bore 43 at the intermediate position.

When the stopper piston 32 reaches the intermediate position, the stopper piston 32 is fitted in the fitting bore 41 by means of the urging force of the spring 37 and the force received from the hydraulic chamber 46 because the working fluid is not introduced in the hydraulic chambers 42 and 45.

The stopper piston 32 is fitted in the enlarged bore 43, even though the stopper piston 32 is not fitted in the fitting bore 41 before the engine is started. The stopper piston 32 is fitted in the fitting bore 41 promptly when the engine is started, the camshaft 2 is held at the intermediate position with respect to the crankshaft, and thereby the engine is started surely in a short time.

Because the valve position 213*a* of the switching valve 212 is selected during cranking when the engine is to be started, the working fluid is supplied to the advance hydraulic chambers and the hydraulic chambers 45 and 46. The retard hydraulic chambers and the hydraulic chamber 42 are opened to the drain. Furthermore, in the state that the stopper piston 32 is fitted in the fitting bore 41 as shown in FIG. 7A, the through hole 30*a* is closed by the large diameter sliding portion 34. Thus, the working fluid in the hydraulic chamber 45 does not exert a force to pull out the stopper piston 32 from the fitting bore 41. Therefore, the stopper piston 32 is not pulled out from the fitting bore 41.

After the working fluid is charged in the retard hydraulic chamber and the hydraulic pressure increases up to a predetermined pressure after the engine is started, the stopper piston 32 is pulled out from the fitting bore 41, the relative rotation of the vane rotor 15 with respect to the shoe housing 12, that is, the phase control becomes possible. Because the through hole 30*b* is closed by the large diameter sliding portion 34 when the stopper piston 32 moves in the unconstraint direction shown in FIG. 7C from the fitting bore 41, communication between the hydraulic chamber 46 and the advance hydraulic chamber 54 is shut down, and the hydraulic chamber 46 is almost sealed.

When the hydraulic pressure of the working fluid increases sufficiently after the engine is started, the any one of the valve positions 213*a,* 213*b* and 213*c* of the valve member 213 is selected correspondingly to the instruction supplied from the ECU 300. Thereby, supply of the working fluid to the hydraulic chambers and discharge of the working fluid from the hydraulic chambers are controlled. The relative rotation of the vane rotor with respect to the shoe housing 12 is controlled.

The stopper piston 32 is positioned at the place farther from the position shown in FIG. 7C in the pulling out direction. Therefore, the hydraulic chamber 46 is almost sealed as described above, when the stopper piston 32 is to be moved toward the fitting member 40 due to reduction of the hydraulic pressure of the hydraulic chambers 42 and 45. The hydraulic chamber 46 functions as a damper chamber to thereby reduce the moving speed.

Therefore, when the stopper piston 32 passes through the intermediate position during advance angle control, the stopper piston 32 passes on the fitting member 40 before the stopper piston 32 is fitted in the fitting member 40 by means of the damper action of the hydraulic chamber 46 in addition to the advance hydraulic pressure exerted on the annular surface 34*a*. As a result, the stopper piston 32 is prevented from being fitted with the fitting member 40.

When the stopper piston 32 passes through the intermediate position during retard angle control, the stopper piston 32 passes on the fitting member 40 before the stopper piston 32 is fitted with the fitting member 40 by means of the damper action of the hydraulic chamber 46 in addition to the retard hydraulic pressure exerted on the tope end surface 33*b*. The stopper piston 32 is prevented from being fitted with the fitting member 40. The stopper piston 32 has the top end surface 33*b* on which the retard hydraulic pressure is exerted in the direction to pull out the stopper piston 32 from the fitting member 40, and has the annular surface 34*a* on which the advance hydraulic pressure is exerted in the direction to pull out the stopper piston 32 from the fitting member 40. As a result, the stopper piston 32 is held in the unconstraint state associated with the fitting member 40. Furthermore, because the hydraulic chamber 46 functions as a damper chamber in the unconstraint state, the stopper piston 32 is held in the unconstraint state associated with the fitting member 40.

In the third embodiment, the through hole 30*a* that communicates between the hydraulic chamber 45 and the advance hydraulic chamber 54 and the through hole 30*b* that communicates between the hydraulic chamber 46 and the advance hydraulic chamber 54 are opened/closed by displacing the stopper piston 32. Thus, the through holes 30*a* and 30*b* are opened/closed surely by displacing the stopper piston 32. Because other open/close valves and switching valves are not needed for opening/closing the through holes 30*a* and 30*b,* the number of needed parts is reduced, assembling work becomes simple, and the manufacturing cost is reduced.

Furthermore, the pressure receiving area of the top end surface 33*b* is larger than that of the annular surface 34*a* and the annular surface 34*b*. Therefore, even though the retard hydraulic pressure decreases due to pulsation, the stopper piston 32 and the fitting member 40 are held in the unconstraint state by means of the force received from the retard hydraulic pressure.

Furthermore, the force received from the hydraulic chamber 45 in the direction to pull out the stopper piston 32 from the fitting bore 41 is larger than the force received from the hydraulic chamber 46 in the direction to push the stopper piston 32 toward the fitting member 40. Therefore, the unconstraint state associated with the stopper piston 32 and the fitting member 40 can be held during normal operation of the engine.

(Fourth Embodiment)

Figure 12A:
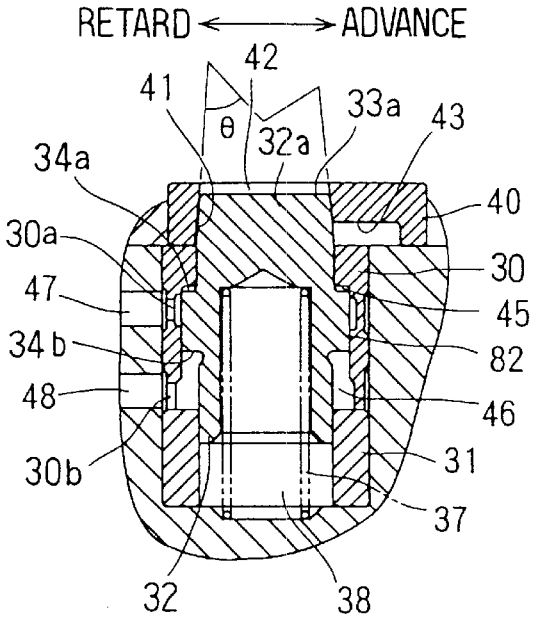
FIGS. 12A and 12B are cross sectional views showing position of a stopper piston in a fourth embodiment of the present invention.
Figure 12B:
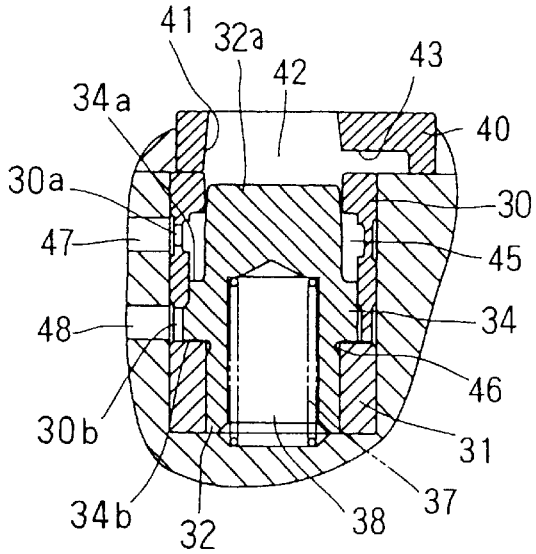
Figure 13:
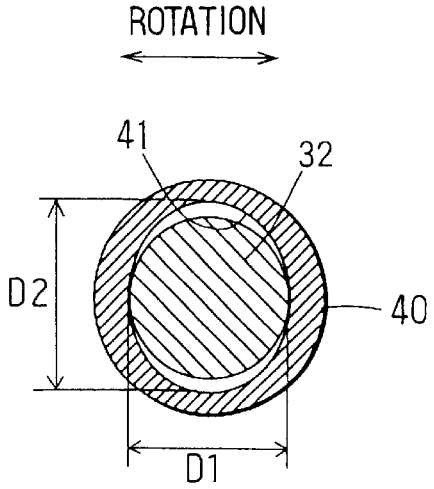
FIG. 13 is a cross sectional view showing shape of a fitting member in the fourth embodiment.

In a fourth embodiment shown in FIGS. 12A and 12B, the stopper piston 32 has the top end surface 33*a* that serves as the first pressure receiving portion formed on the top end, the annular surface 34*a* that serves as the second pressure receiving portion formed on the fitting bore side of the large diameter sliding portion 34 and the annular surface 34*b* that serves as the third pressure receiving portion formed on the side opposite to the fitting bore side of the large diameter sliding portion 34. The pressure receiving area of the top end surface 32*a* is larger than the pressure receiving surface of the annular surface 34*a* and the annular surface 34*b*. Furthermore, the pressure receiving area of the annular surface 34*a* is larger than the pressure receiving surface of the annular surface 34*b*.

It is possible that the through hole 30*a* that serves as the second pressure receiving passage formed on the guide ring 30 supplies the working fluid of the advance hydraulic pressure to the hydraulic chamber 45. The through hole 30*a* is restricted at some portion of the passage. When the stopper piston 32 is to be moved toward the fitting member 40 side, the restricted passage of the through hole 30*a* functions to reduce the speed of motion of the stopper piston 32 toward the fitting member 40. Therefore, the fitting of the stopper piston 32 in the fitting member 40 due to reduction of the working fluid hydraulic pressure during normal operation of the engine is prevented, and the phase is controlled smoothly.

The through hole 30*b* that serves as the third pressure receiving passage formed on the guide ring 30 supplies the working fluid of the advance hydraulic pressure to the hydraulic chamber 46. As shown in FIG. 12B, the through hole 30*b* is closed by the large diameter portion 34 when the stopper piston 32 is positioned farthest from the fitting member 40, but is opened when the stopper piston 32 moves only slightly toward the fitting member 40 side from the position shown in FIG. 12B. Therefore, the hydraulic chamber 46 functions to push the stopper piston 32 toward the fitting member 40 when the working fluid of the advance hydraulic pressure is supplied, and does not act as a damper chamber.

The taper angle θ of the top end 34 of the stopper piston 32 is smaller than 15 degrees as in the second embodiment (FIG. 6A). Further, the diameter D2 of the fitting bore 41 in the direction perpendicular to the rotation direction is larger than the diameter D1 of the fitting bore 41 in the rotation direction as in the second embodiment (FIG. 6B).

Even if the fitting bore 41 or the stopper piston 32 has some manufacturing allowance in the direction perpendicular to the rotation direction, the stopper piston 32 can be fitted in the fitting bore 41. Because the limit of the manufacturing allowance is eased, the manufacturing cost is reduced.

In the third and fifth embodiments, the retard hydraulic pressure and advance hydraulic pressure are exerted on the stopper piston in the direction to be pulled out from the fitting bore and enlarged bore. Either of the retard hydraulic pressure and the advance hydraulic pressure is exerted on the stopper piston in the direction to be pulled out from the fitting bore and the enlarged bore during phase control in normal operation of the engine. The stopper piston is prevented from being fitted in the fitting bore during normal operation of the engine.

Furthermore, the advance hydraulic pressure is exerted on the stopper piston in the direction to be pushed toward the fitting member. Therefore, when an engine stop is instructed, the stopper piston is surely fitted in the fitting bore at the intermediate position because the retard hydraulic chamber is opened to the drain and the working fluid is supplied to the advance hydraulic chamber.

In the third to fifth, the first pressure receiving portion for receiving the retard hydraulic pressure in the direction to pull out the stopper piston from the fitting bore and the second pressure receiving portion for receiving the advance hydraulic pressure in the direction to pull out the stopper piston from the fitting bore are formed separately on the stopper piston. Alternatively, one pressure receiving portion for receiving the hydraulic pressure in the direction to pull out the stopper piston from the fitting bore may be formed, and the retard hydraulic pressure and the advance hydraulic pressure may be switched by use of, for example, a differential pressure regulating valve to thereby exert the retard hydraulic pressure or the advance hydraulic pressure that has been switched to the pressure receiving portion.

The present invention should not be limited to the above disclosed embodiments, but may be implemented in many other ways.

For instance, the vale timing adjusting apparatus drives only the exhaust valve, or both the suction valve and exhaust valve. Further, the stopper piston may be moved in the radial direction to be fitted in the fitting bore. The stopper piston may be accommodated in the housing member side and the fitting bore, and the enlarged bore may be formed on the vane rotor side. A timing pulley or timing gear may be employed in place of the chain sprocket. The driving force of the crankshaft that serves as the driving shaft may be received by the vane member to rotate the camshaft that serves as the driven shaft and the housing member.

What is claimed is:

1. A valve timing adjusting apparatus for transmitting a driving force from a driving shaft of an internal combustion engine to a driven shaft for opening/closing at least one of a suction valve and an exhaust valve, the apparatus comprising:

a driving side rotor that rotates together with the driving shaft;

a driven side rotor that rotates together with the driven shaft and that is relatively rotationally driven with respect to the driving side rotor by means of working fluid pressure;

an accommodation chamber formed in one of the driving side rotor and the driven side rotor;

a vane formed with the other of the driving side rotor and the driven side rotor and accommodated in the accommodation chamber;

constraint means provided on the driving side rotor and the driven side rotor, the constraint means having a contact portion and a contact receiving portion for constraining a relative rotation of the driven side rotor with respect to the driving side rotor by being in contact each other when the driven side rotor is positioned at an intermediate position with respect to the driving side rotor between both ends in a circumferential direction in a predetermined angular range, and the constraint means having contact urging means for urging the contact portion in a direction to be brought into contact with the contact receiving portion, wherein the contact portion receives a force in a direction to release a constraint with the contact receiving portion against an urging force of the contact urging means by means of a first working fluid pressure that drives the driven side rotor toward one of an advance side and a retard side with respect to the driving side rotor, and receives a force in a direction to be brought into contact with the contact receiving portion by means of a second working fluid pressure that drives the driven side rotor in a direction of the other of the advance side and the retard side with respect to the driving side rotor.

2. The valve timing adjusting apparatus as in claim 1, wherein the first working fluid pressure is applied to rotate the driven side rotor to the retard side, and the second working fluid pressure is applied to rotate the driven side rotor to the advance side.

3. The valve timing adjusting apparatus as in claim 1, wherein the contact portion has a first pressure receiving portion that receives the first working fluid pressure, and has a second pressure receiving portion that receives the second working fluid pressure in a direction opposite to a receiving direction of the first working fluid pressure applied to the first pressure receiving portion.

4. The valve timing adjusting apparatus as in claim 1, wherein the contact portion has a first pressure receiving portion and a third pressure receiving portion that receive a first working fluid pressure in the same direction, and has a second pressure receiving portion that receives the second working fluid pressure in a direction opposite to a receiving direction of the first working fluid pressure applied to the first pressure receiving portion.

5. The valve timing adjusting apparatus as in claim 1, further comprising:

a working fluid passage for supplying the second working fluid to the contact portion, wherein the working fluid passage is closed while the contact portion is being unconstrained with the contact receiving portion, and is opened when the unconstraint state associated with the contact portion and the contact receiving portion changes to the constraint state.

6. The valve timing adjusting apparatus as in claim 5, wherein opening/closing of the working fluid passage is operated by means of displacement of the contact portion.

7. The valve timing adjusting apparatus as in claim 1, wherein the contact receiving portion has a fitting bore that can be fitted with the contact portion, and the contact portion and the fitting bore are formed to have a circular cross section with taper.

8. The valve timing adjusting apparatus as in claim 7, wherein the taper angle of the contact portion is smaller than 15 degrees.

9. The valve timing adjusting apparatus as in claim 1, wherein the contact receiving portion has a fitting bore that can be fitted with the contact portion and that is formed to be shallower than the fitting bore around the fitting bore so that the driven side rotor is prevented from rotating toward the retard side beyond an intermediate position between a most retarded angle and a most advanced angle, and has an enlarged bore that allows the driven side rotor to rotate toward the advance side beyond the intermediate position.

10. The valve timing adjusting apparatus as in claim 1, wherein the contact receiving portion has a fitting bore that can be fitted with the contact portion and that is formed in the form of a slotted hole in a direction perpendicular to the rotation direction of the fitting bore.

11. The valve timing adjusting apparatus as in claim 1, wherein a damper chamber for reducing the displacement speed of the contact portion in the direction to be brought into contact with the contact receiving portion in the unconstraint state is formed on the outer periphery of the contact portion.

12. The valve timing adjusting apparatus as in claim 11, wherein a damper action of the damper chamber is released when the unconstraint state associated with the contact portion and the contact receiving portion changes to the constraint state.

13. The valve timing adjusting apparatus as in claim 12, wherein the damper action of the damper chamber is released by displacing the contact portion.

14. The valve timing adjusting apparatus as in claim 1, further comprising:

advance urging means for urging the driven side rotor toward the advance side.

15. The valve timing adjusting apparatus as in claim 1, wherein a side opposite to the contact receiving side of a space for accommodating the contact portion is open to atmosphere in the relative rotation angle range of the driven side rotor with respect to the driving side rotor.

16. A valve timing adjusting apparatus for transmitting a driving force from a driving shaft of an internal combustion engine to a driven shaft for opening/closing at least one of a suction valve and an exhaust valve, the apparatus comprising:

a driving side rotor that rotates together with the driving shaft;

a driven side rotor that rotates together with the driven shaft and that is relatively rotationally driven with respect to the driving side rotor by means of working fluid pressure;

an accommodation chamber formed in one of the driving side rotor and the driven side rotor;

a vane formed with the other of the driving side rotor and the driven side rotor and accommodated in the accommodation chamber;

constraint means provided on the driving side rotor and the driven side rotor, the constraint means having a contact portion and a contact receiving portion for constraining a relative rotation of the driven side rotor with respect to the driving side rotor by being in contact each other when the driven side rotor is positioned at an intermediate position with respect to the driving side rotor between both ends in a circumferential direction in a predetermined angular range, and the constraint means having contact urging means for urging the contact portion in a direction to be brought into contact with the contact receiving portion, wherein the contact portion receives a force in a direction to release a constraint with the contact receiving portion against an urging force of the contact urging means by means of a first working fluid pressure that drives the driven side rotor toward one of an advance side and a retard side with respect to the driving side rotor and a second working fluid pressure that drives the driven side rotor in a direction of the other of the advance side and the retard side with respect to the driving side rotor, and receives a force in a direction to be brought into contact with the contact receiving portion by means of the second working fluid pressure.

17. The valve timing adjusting apparatus as in claim 16, wherein the first working fluid pressure is applied to rotate the driven side rotor to the retard side, and the second working fluid pressure is applied to rotate the driven side rotor to the advance side.

18. The valve timing adjusting apparatus as in claim 16, wherein the contact portion has a first pressure receiving portion that receives the first working fluid pressure, a second pressure receiving portion that receives the second working fluid pressure in a same direction as a receiving direction of the first working fluid pressure applied to the first pressure receiving portion, and a third pressure receiving portion that receives the second working fluid in a direction opposite to the receiving direction of the second pressure receiving portion.

19. The valve timing adjusting apparatus as in claim 18, wherein a pressure receiving area of the first pressure receiving portion is larger than a pressure receiving area of the second pressure receiving portion and the third pressure receiving portion.

20. The valve timing adjusting apparatus as in claim 18, wherein the pressure receiving area of the second pressure receiving portion is larger than the pressure receiving area of the third pressure receiving portion.

21. The valve timing adjusting apparatus as in claim 18, wherein a pressure receiving passage for supplying the second working fluid to the third pressure receiving portion is closed in an unconstraint state associated with the contact portion and the contact receiving portion, and is opened when the unconstraint state associated with the contact portion and the contact receiving portion changes to the constraint state.

22. The valve timing adjusting apparatus as in claim 21, wherein the pressure receiving passage is opened/closed by displacing the contact portion.

23. The valve timing adjusting apparatus as in claim 18, wherein a pressure receiving passage for supplying the second working fluid to the second pressure receiving portion is closed immediately before the contact portion is brought into contact with the contact receiving portion.

24. The valve timing adjusting apparatus as in claim 23, wherein opening/closing of the working fluid passage is operated by means of displacement of the contact portion.

25. The valve timing adjusting apparatus as in claim 18, wherein the pressure receiving passage for supplying the second working fluid to the second pressure receiving portion is provided with a restrictor.

26. The valve timing adjusting apparatus as in claim 16, wherein the contact receiving portion has a fitting bore that can be fitted with the contact portion, and the contact portion and the fitting bore are formed to have a circular cross section with taper.

27. The valve timing adjusting apparatus as in claim 26, wherein the taper angle of the contact portion is smaller than 15 degrees.

28. The valve timing adjusting apparatus as in claim 16, wherein the contact receiving portion has a fitting bore that can be fitted with the contact portion and that is formed in the form of a slotted hole in a direction perpendicular to the rotation direction of the fitting bore.

29. The valve timing adjusting apparatus as in claim 16, wherein the contact receiving portion has a fitting bore that can be fitted with the contact portion, and has an enlarged bore formed around the fitting bore to be shallower in depth than the fitting bore that allows the driven side rotor to rotate toward the advance side beyond the intermediate position between the most retarded angle and the most advanced angle.

30. The valve timing adjusting apparatus as in claim 16, wherein a damper chamber for reducing the displacement speed of the contact portion in the direction to be brought into contact with the contact receiving portion in the unconstraint state is formed on an outer periphery of the contact portion.

31. The valve timing adjusting apparatus as in claim 30, wherein a damper action of the damper chamber is released when the unconstraint state associated with the contact portion and the contact receiving portion changes to the constraint state.

32. The valve timing adjusting apparatus as in claim 31, wherein the damper action of the damper chamber is released by displacing the contact portion.

33. The valve timing adjusting apparatus as in claim 16, further comprising:

advance urging means for urging the driven side rotor toward the advance side.

34. The valve timing adjusting apparatus as in claim 16, wherein a side opposite to the contact receiving side of a space for accommodating the contact portion is open to atmosphere in the relative rotation angle range of the driven side rotor with respect to the driving side rotor.

* * * * *